US005125534A

United States Patent [19]

Rose et al.

[11] Patent Number: 5,125,534

[45] Date of Patent: Jun. 30, 1992

[54] BEVERAGE FLAVORING AND DISPENSING APPARATUS AND METHOD OF CONSTRUCTION

[76] Inventors: Barry L. Rose, 101 Lasaine Ave., Northridge, Calif. 91325; Mario J. Machado, 5750 Briar Cliff Rd., Los Angeles, Calif. 90068; Alan R. Stein, 20017 Lanark, Canoga Park, Calif. 91306

[21] Appl. No.: 641,041

[22] Filed: Jan. 14, 1991

[51] Int. Cl.[5] ..... B67D 5/00

[52] U.S. Cl. ..... 222/54; 99/494; 222/129; 426/112; 426/115

[58] Field of Search ..... 222/54, 129, 189, 192; 426/77, 82, 85, 112, 115; 99/494

[56] References Cited

U.S. PATENT DOCUMENTS

| | | | |
|---|---|---|---|
| 3,144,152 | 8/1964 | Kopp | 426/115 X |
| 3,252,803 | 5/1966 | Belasco | 99/78 |
| 3,312,555 | 4/1967 | Rossi et al. | 99/138 |
| 3,610,483 | 10/1971 | Visconti et al. | 222/478 |
| 3,643,834 | 2/1972 | Sabitino | 222/54 |
| 3,853,479 | 12/1974 | Rodgers | 222/85 X |
| 3,869,555 | 3/1975 | Heonis | 426/134 |
| 4,061,783 | 12/1977 | Hoffman et al. | 426/87 |
| 4,298,145 | 11/1981 | Iida | 222/478 |
| 4,338,338 | 7/1982 | Popkes | 426/82 |
| 4,387,809 | 6/1983 | Botzler | 222/129 X |
| 4,816,268 | 3/1989 | Tsau | 426/85 |
| 4,849,231 | 7/1989 | Spee | 426/87 |
| 4,860,929 | 8/1989 | Lowe et al. | 222/189 |
| 4,891,232 | 1/1990 | Dahl | 426/78 |
| 4,921,713 | 5/1990 | Fowler | 426/85 |
| 4,996,066 | 2/1991 | Love et al. | 426/77 |

FOREIGN PATENT DOCUMENTS 3616207 11/1987 Fed. Rep. of Germany ..... 222/129

*Primary Examiner*—Michael S. Huppert
*Assistant Examiner*—Joseph A. Kaufman
*Attorney, Agent, or Firm*—John S. Christopher

[57] ABSTRACT

A beverage flavoring and dispensing apparatus 10 for use in a fluid having a capped upper body chamber 12 which interfaces with a dissolvable lower housing 18, the upper body chamber having fused thereto a central spine member 14 with a plurality of horizontally extending vanes 16. The spine member and the vanes extend from the top of the chamber 12 to the bottom of the lower housing 18 forming a plurality of compartments 20 between adjacent vanes 16 and the chamber 12 and housing 18 for carrying a plurality of selected flavoring ingredients 22 therein. The lower housing 18 is comprised of a dissolvable film such as methyl cellulose or gelatin which dissolves upon immersion in a fluid simultaneously dispensing each of the flavoring ingredients in the fluid. The spine member 14 and the associated vanes 16 are then utilized as a stirring stick for mixing the ingredients of the beverage. The apparatus 10 substantially increases the number of separated dissolvable flavoring ingredients carried in a single dispenser and improves the dispensing efficiency by simultaneously releasing each of the ingredients. Alternative embodiments 100, 200 are also disclosed which eliminate the spine member and vanes for forming a single compartment 120, 220 which dispenses a single premixed ingredient 122, 222 through a plurality of dissolvable film covered window openings 104, 204 when immersed in a fluid.

20 Claims, 2 Drawing Sheets

BEVERAGE FLAVORING AND DISPENSING APPARATUS AND METHOD OF CONSTRUCTION

BACKGROUND OF THE INVENTION

1. Field of the Invention

The present invention relates to beverage flavoring and dispensing devices for use in consumable fluid, and more particularly, to a new and improved beverage flavoring and dispensing device and method of construction of the type having an upper body chamber which serves as a storage area and a mixing handle and a dissolvable lower housing comprising multiple compartments for carrying and dispensing a plurality of comestible ingredients into a fluid.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

In the field of instant beverage dispensing products, much progress has been made in providing consumable fluids such as coffee, tea, hot chocolate, bouillon, etc. in a fast and convenient manner. The use of convenience type dispensing devices has long been recognized as an effective way to flavor beverages. Such flavoring and dispensing devices are often utilized at locations remote from a regular food preparation area such as construction sites, recreation areas, athletic events, office environments, and the like.

Such convenience flavoring and dispensing devices might include any of the following structures: a stirring spoon or blade having a dissolvable substance adhered thereto including edible solvents; a shaped block of sugar mounted on a stick and designed to serve as a stirrer for beverages including the feature of printed advertising information on the stick; a dry concentrated article for the preparation of instant beverages when combined with a liquid and comprising a stirring stick, a base mass and a flavoring mass; a thin flat packaged utensil in a protective sheath including a substance interactive with fluid; a spoon-shaped strainer configuration employed as a storage and dispensing container; a straw having a unit charge of a comestible product mounted therein for dispensing unit dose amounts into a liquid as the liquid is vacuum drawn therethrough; a disposable stirring rod on which a sweetener or other substance is held for adding to fluids; an elongated tubular device of unitary construction sealed at both ends for dispensing soluble granular materials; and a beverage device packaged as a stirring-type stick and including an attached porous bag with infusion solid particulates contained therein.

Unfortunately, none of the above described flavor or dispensing devices provide a multiple compartment dispenser which is capable of simultaneously dispensing multiple dry flavoring ingredients into a fluid. Consequently, when any of the above-described flavor or dispensing devices are employed, other individual ingredients not included with the dispensed ingredients must be added separately resulting in inconvenience.

Hence, those concerned with the development and use of convenience type flavoring and dispensing devices in the instant beverage dispensing products industry have long recognized the need for an improved beverage flavoring and dispensing device having multiple compartments which are capable of simultaneously dispensing multiple dry flavoring ingredients simply by inserting the device into a fluid. Further, there is a need for such a device that can be utilized in the absence of any additional utensil, which is simple to fabricate and in which the number of compartments necessary is determined by the intended use. The present invention fulfills all of these needs.

SUMMARY OF THE INVENTION

The need in the art is addressed by the new and improved beverage flavoring and dispensing apparatus of the present invention. Briefly, and in general terms, the beverage flavoring and dispensing device substantially increases the number of separated dissolvable flavoring ingredients carried therein, and significantly improves the dispensing efficiency by simultaneously releasing each of the stored ingredients. Moreover, the device can be utilized in the absence of any additional utensil, is simple to fabricate and the number of compartments necessary can be determined by the intended use.

Basically, the present invention is directed to an improved flavoring and dispensing apparatus and method of construction having multiple compartments capable of simultaneously dispensing multiple dry flavoring ingredients simply by inserting the apparatus into a fluid. This is accomplished by providing an upper body chamber with a spine structure having a plurality of vanes or blades horizontally projecting therefrom. The spine and vane projections extend into a lower housing for forming the multiple compartments. The lower housing is a dissolvable film, such as a gelatin or methyl cellulose encasement, formed to fit over the bottom portion of the spine and the associated horizontally projecting vanes. Each of the multiple compartments are individually filled with a flavoring ingredient prior to dispensing.

During use, the flavoring and dispensing apparatus is inserted into a fluid. In accordance with the improved method of the present invention, the flavoring and dispensing apparatus can be immersed in hot or cold fluid permitting the gelatin or methyl cellulose encasement of the lower housing to dissolve in the fluid. Thereafter, the ingredients carried within the multiple compartments are dispensed into the fluid. The upper body chamber can then be utilized as a stirring stick with the horizontally projecting vanes mixing the ingredients in the fluid for forming the beverage. Thus, the present invention provides a beverage flavoring and dispensing apparatus which substantially increases the number of separated dissolvable flavoring ingredients carried therein and significantly improves the dispensing efficiency by simultaneously releasing each of the stored ingredients. Alternative embodiments disclose a single compartment structure having a dissolvable lower housing but without a spine and the associated vane projections.

These and other features and advantages of the present invention will become apparent from the following more detailed description, when taken in conjunction with the accompanying drawings, which illustrate, by way of example, the features of the invention.

DESCRIPTION OF THE INVENTION

Figure 1:
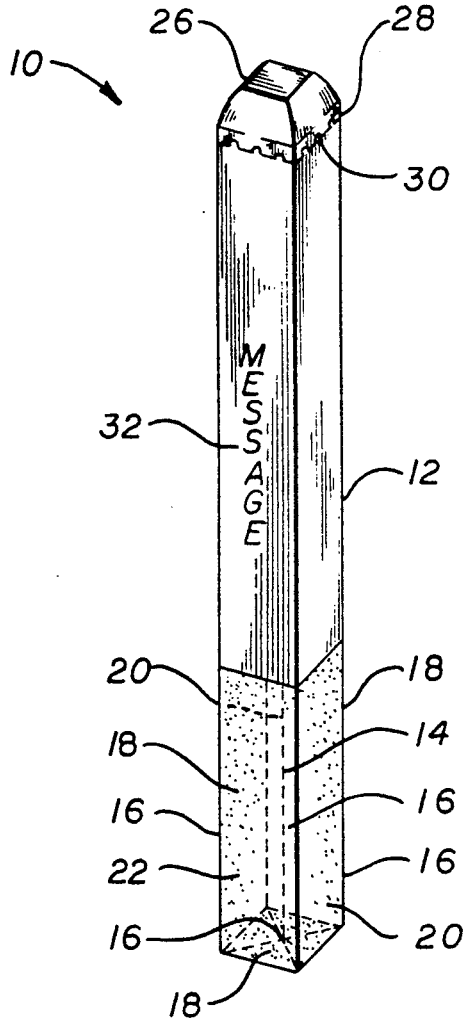
FIG. 1 is a perspective view of an illustrative embodiment of a beverage flavoring and dispensing apparatus in accordance with the present invention, partly in phantom, and showing multiple vanes horizontally projecting from the spine.

As shown in the drawings for purposes of illustration, the invention is embodied in a beverage flavoring and dispensing apparatus 10 of the type having an upper body chamber 12 including a central spine member 14 having a plurality of vanes or blades 16 projecting horizontally therefrom for serving as a mixing instrument and for extending into a dissolvable lower housing 18 which forms a plurality of compartments 20 with the vanes 16 for dispensing selected flavoring ingredients 22 upon the dissolution of the lower housing 18 in a fluid.

The use of convenience type flavoring devices for dispensing selected ingredients for brewing coffee, tea, hot chocolate, bouillon, etc. in consumable fluids is widespread. Typically, such flavoring devices are used at locations remote from a regular food preparation area and can include any number of devices known in the past. A problem associated with these prior art devices is that they do not disclose a multiple compartment dispenser which is capable of simultaneously dispensing multiple dry flavoring ingredients into a fluid. Consequently, when these known flavor dispenser devices are employed, other individual ingredients not included with the dispensed ingredients must be added separately resulting in inconvenience.

In accordance with the present invention, the spine member 14 and the associated horizontal projecting vanes 16 cooperate with the dissolvable lower housing 18 to form the plurality of individual compartments 20 for storing the selected flavoring ingredients 22 and to simultaneously dispense such ingredients upon the dissolution of the lower housing 18 in a fluid. Further, the beverage flavoring and dispensing apparatus 10 can be utilized in the absence of any additional utensil, is simple to fabricate and the number of individual compartments 20 can be determined by the intended use.

Figure 2:
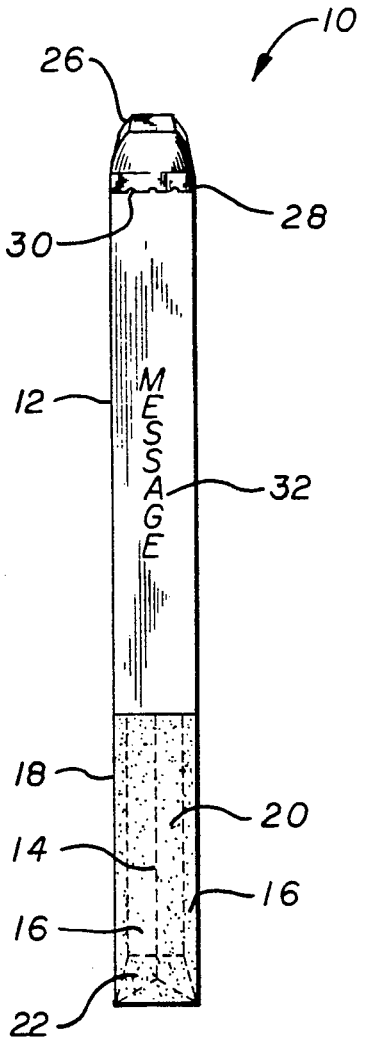
FIG. 2 is a frontal elevational view of the beverage flavoring and dispensing apparatus of FIG. 1 showing an individual compartment formed between two vanes extending from the spine for storing dissolvable ingredients.
Figure 3A:
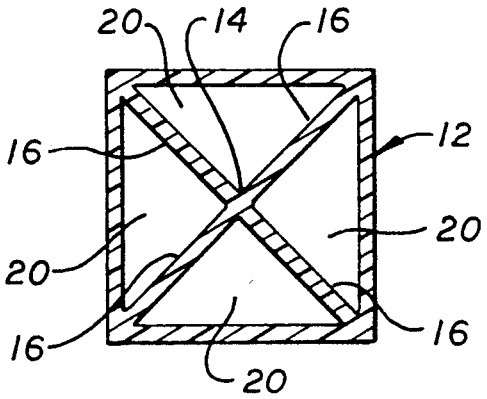
FIG. 3A is a plan view of the beverage flavoring and dispensing apparatus of FIG. 1 showing four storage compartments formed by the vanes horizontally projecting from the spine.
Figure 3B:
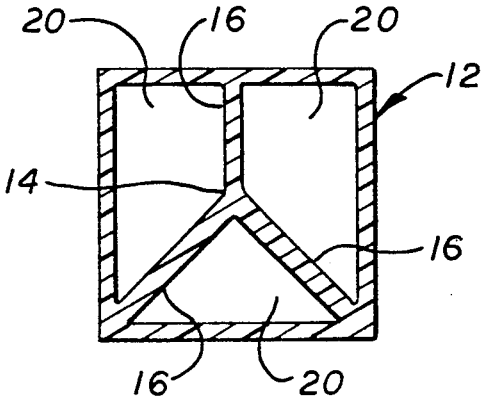
FIG. 3B is a plan view of the beverage flavoring and dispensing apparatus of FIG. 1 showing three storage compartments formed by the vanes horizontally projecting from the spine.
Figure 4:
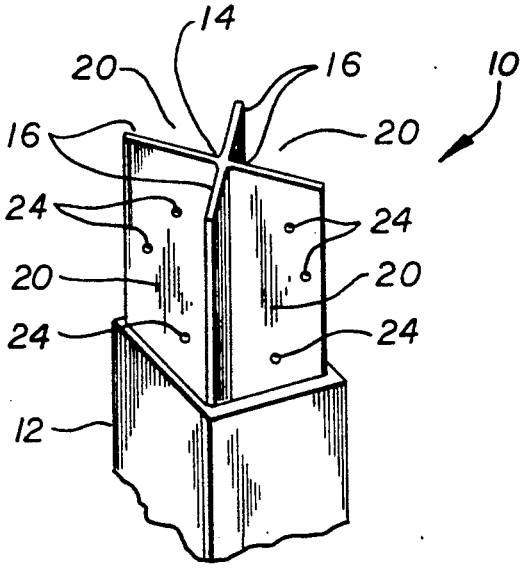
FIG. 4 is a fragmentary perspective view of the beverage flavoring and dispensing apparatus of FIG. 1 with the dissolvable lower housing removed for showing the vanes horizontally projecting from the spine.

The two main components of the beverage flavoring and dispensing apparatus 10 are the upper body chamber 12 and the dissolvable lower housing 18 as shown in FIGS. 1 and 2. The upper body chamber 12 can be manufactured from a rigid material such as plastic. Although shown as a rectangular parallelepiped structure, the upper body chamber, lower housing 18 and associated structural components could be formed in any suitable configuration. The spine member 14 and the associated horizontally projecting vanes 16 can also be comprised of plastic and are fused to the upper body chamber 12 at the corners thereof forming a unitary construction as shown in FIGS. 3A and 3B. Therefore, movement of the upper body chamber 12 carries the spine member 14 and the vanes 16 therewith as shown in FIG. 4. The spine member and the vanes formed thereon extend from the top of the upper body chamber to the bottom of the lower housing 18 along the central vertical axis of the apparatus 10. Generally, the area bounded by any two adjacent vanes 16 and either the upper body chamber 12 or the lower housing 18 forms one of the plurality of individual compartments 20 for storing and dispensing the flavoring ingredients 22. Typically, that portion of each compartment 20 bounded by the adjacent vanes 16 and the upper body chamber 12 is hollow and provides storage space for a larger charge of a particular ingredient 22. The flavoring ingredients 22 normally settle to the bottom of the compartment 20 bounded by the adjacent vanes 16 and the lower housing 18.

The number of individual compartments 20 formed in both the upper body chamber 12 and the lower housing 18 is determined by the number of vanes 16 formed on the spine member 14. However, the number of vanes formed on the spine member is determined by the number of ingredients 22 to be carried by the particular flavoring and dispensing apparatus 10. Therefore, the fundamental design of the present invention is applicable to a plurality of beverage flavoring and dispensing apparatuses as is clearly illustrated by FIGS. 3A and 3B. FIG. 3A exhibits a design having four individual compartments 20 centered about the spine member 14 when viewed from the top while FIG. 3B exhibits a design having three such individual compartments centered about a corresponding spine member when viewed from the top.

Figure 5:
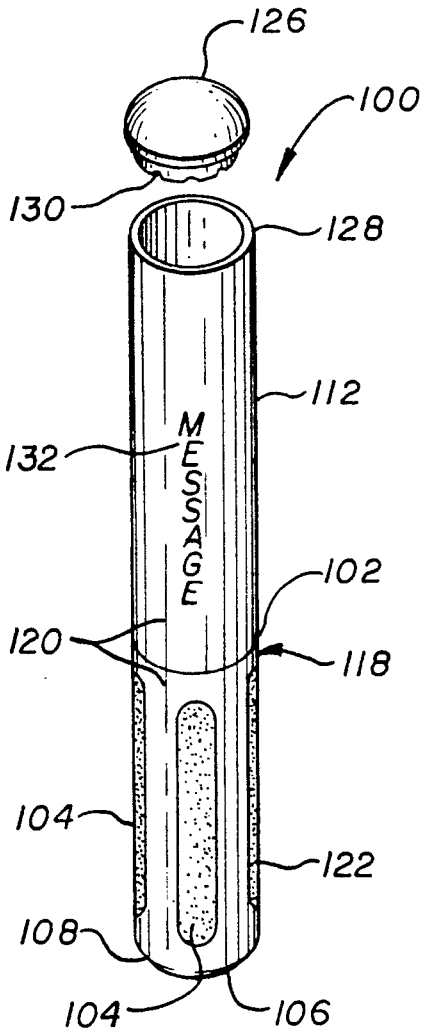
FIG. 5 is a perspective view of a first alternative embodiment of a beverage flavoring and dispensing apparatus in accordance with the present invention illustrating a single storage compartment and a plurality of film-covered openings in the lower housing.
Figure 6:
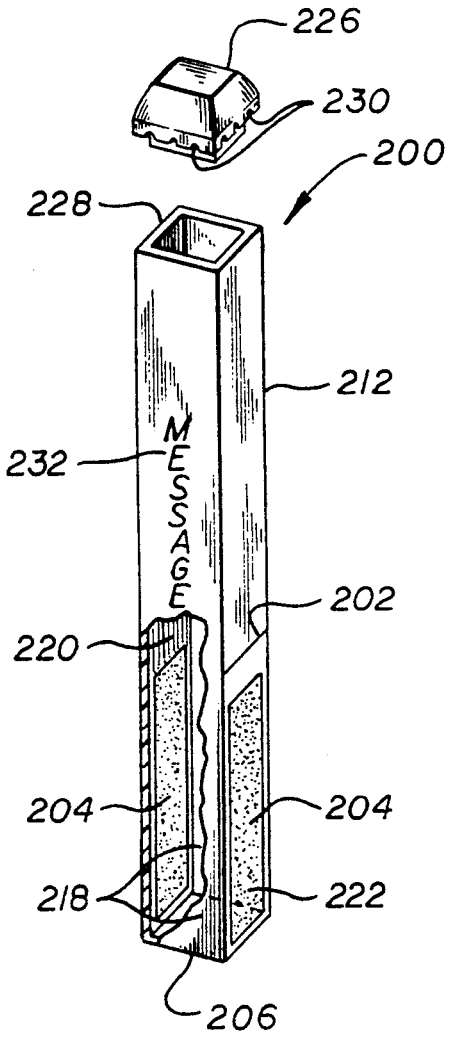
FIG. 6 is a perspective view of a second alternative embodiment of a beverage flavoring and dispensing apparatus in accordance with the present invention illustrating a single storage compartment and a pair of film-covered windows in the lower housing.

Further, the number of individual compartments 20 can be selected to match the number of specific ingredients 22 to be stored in the beverage flavoring and dispensing apparatus 10. For example, a single premixed ingredient for beverages such as bouillon or hot chocolate would not necessarily require the use of the spine member 14 and the associated vanes 16. Under these conditions, the upper body chamber 12 and the lower housing 18 would form a single compartment for storing the dry concentrated mix for the bouillon, hot chocolate or the like. Thereafter, immersion of the lower housing 18 in fluid would cause the film to dissolve dispensing the premixed ingredient as is shown in FIGS. 5 and 6. For a beverage requiring two ingredients such as coffee with sugar the spine member 14 having two opposing vanes 16 would be required for forming two individual compartments 20 within both the upper body chamber 12 and the lower housing 18. For beverages requiring three or more ingredients the spine member with the necessary number of vanes 16 would be required for forming three or more compartments as is shown in FIGS. 3A and 3B.

The lower housing 18 is a film comprised of any one of several consumable products that readily dissolve when immersed in a fluid. Examples of such consumable products include, but are not limited to, gelatin film or methyl cellulose. Other products possibly meeting these requirements include polyvinyl alcohol and a starch based membrane. The dissolvable film forming the lower housing 18 is formed to fit over the bottom portion of the spine member 14 and the associated horizontally extending vanes 16. The dissolvable film, in the case of a gelatin encasement, is an edible brittle protein commonly used in food and drugs and is employed to separate and to keep sanitary the ingredients prior to dispensing. The ingredients can be in any desirable form such as powdered, solid, concentrated or the like.

The dissolvable film, preferably comprised of the gelatin encasement or methyl cellulose, must be formed to seal around the bottom of the upper body chamber 12. This is accomplished by wrapping the film about the spine member 14 and the associated vanes 16 in a technique that is well known in the art of forming such soluble films. Once the film is formed creating the lower housing 18, the film is either heat sealed or cemented to the upper body chamber. This process creates the individual compartments 20 which store the selected ingredients 22.

After assembly, the lower housing 18 of the flavoring and dispensing apparatus 10 can be immersed in hot or cold fluid for permitting the soluble film to dissolve in the liquid. After the lower housing dissolves, the flavoring ingredients 22 carried in the individual compartments 20 are dispensed into the fluid. The upper body chamber 12 can then be used as a stirring stick permitting the vanes 16 extending from the spine member 14 to mix the ingredients 22 into the fluid for forming the beverage. To further improve the mixing capability, each of the vanes 16 can include a plurality of holes 24 to provide flow-through mixing. Prior to use, the holes are filled with the dissolvable film (such as gelatin plugs) to prevent the ingredients 22 in the individual compartments 20 from mixing. However, once the lower housing 18 is immersed in the fluid, the gelatin plugs dissolve exposing the plurality of holes 24.

The flavoring and dispensing apparatus 10 carries a cap 26 which can be sealed to the upper body chamber 12 before or after the ingredients 22 are added. The cap 26 seals to the upper body chamber 12 at an interface 28 formed therebetween as shown in FIGS. 1, and 2. Further, a plurality of air holes 30 are formed at the interface 28 between the cap 26 and the upper body chamber 12 to assist in readily dispensing of the ingredients 22. When sealed, the cap 26 is permanently joined to the upper body chamber in a manner which prevents tampering with the ingredients, such as by heat sealing.

Loading of the selected flavoring ingredients 22 into the flavoring and dispensing apparatus 10 can be accomplished by two separate methods. Those methods include top loading and bottom loading of which top loading is the preferred method. In top loading, the main assembly components include the upper body chamber 12 with the spine member 14 and the vanes 16 fused thereto, the dissolvable lower housing 18 and the cap 26. After the lower housing 18 is in place and before the cap 26 is fitted, the flavoring ingredients 22 are inserted into the individual compartments 20 from the top of the upper body chamber. The proportion or ratio of the flavoring ingredients deposited into the individual compartments is directly related to the beverage being prepared.

In bottom loading, the cap 26 is initially heat sealed to the upper body chamber 12 prior to loading the flavoring ingredients 22. Prior to forming the dissolvable lower housing 18, the flavoring and dispensing apparatus 10 is turned upside down for providing access to the individual compartments 20 as is clearly shown in FIG. 4. The compartments are then filled in the proper proportions with the desired ingredients. The plurality of air holes or vents 30 are sized and positioned to avoid leakage of the ingredients during bottom loading. The dissolvable lower housing 18 is then formed about the spine member 14 and the associated vanes 16. Thereafter, the apparatus 10 is returned to the normal upright position so that the loaded ingredients 22 sink to that portion of the compartments 20 located in the lower housing 18. Since the spine 14 and the associated vanes 16 extend the full vertical distance of the apparatus 10, the ingredients remain in the same compartment in which they were initially deposited in.

In the bottom loading method, the individual compartments 20 can be filled with ingredients only to the level at which the spine 14 and the associated vanes 16 exit the bottom of the upper body chamber 12 as is clearly shown in FIG. 4. Otherwise, any ingredients deposited into the compartments at a level higher than that described above would immediately escape from the compartment. This is one of the reasons why the top loading method is the preferred loading method.

The general method of constructing the flavoring and dispensing apparatus 10 is as follows. Initially, the upper body chamber 12, the spine member 14 and the associated vanes 16 are injection molded as a unitary plastic component. Then, the dissolvable lower housing 18 is formed and heat sealed or cemented in place around the spine member. Thereafter, the selected flavoring ingredients are top loaded into the individual compartments 20. Finally, the cap 26 is heat sealed in place. After use, the residual elements comprising the upper body chamber, the spine member and the vanes can be disposed of in a manner consistent with environmental protection. This feature provides great convenience to the user, however, the residual structure can be recycled consistent with plastic recovery programs. The entire process follows the regulations applicable to food grade construction. Thereafter, each flavoring and dispensing apparatus 10 can be individually sanitary over-wrapped for retail sale. In the alternative, a standard count of the apparatus 10 is packaged in a box under standard sanitary controls.

The outer plastic surface of the upper body chamber 12 includes sufficient space to carry a written message 32. In addition to each of the advantages thus far described, the upper body chamber can have printed thereon a message 32 such as a consumer advertisement, a trademark or the like as is shown in FIGS. 1 and 2. The written message serves to inform consumers of specific products available or, in the alternative, could be used to distribute information significant to the public welfare.

First and second alternative embodiments are disclosed in FIGS. 5 and 6 and are respectively identified by the general reference characters 100 and 200. In each instance, the alternative embodiments each have a construction similar to the apparatus 10 of the preferred embodiment. Therefore, components of the alternative embodiments 100 and 200 which find substantial correspondence in structure and function to those parts of the preferred embodiment of FIGS. (1–4) are designated with corresponding numerals of the one-hundred and two-hundred series, respectively.

The beverage flavoring and dispensing apparatus 100 of the first alternative embodiment includes an upper body chamber 112 having a plastic tubular configuration. In this embodiment, the upper body chamber does not incorporate a spine member or the associated vanes fused thereto but is simply tubular and formed, for example, from a solid injected mold. However, the upper body chamber is joined to a solid plastic lower housing 118 at an interface junction 102. It should be noted that the upper body chamber can be fused to the lower housing to form a single structural component. In effect, the upper body chamber 112 and the lower housing 118 form a single compartment 120 for storing a single premixed flavoring ingredient 122. As before, the upper body chamber carries a cap 126 which is heat sealed to the chamber at a cap interface 128. The cap 126 includes a plurality of air holes 130 for promoting the ready dispensing of the flavoring ingredients 122.

In this embodiment, the lower housing 118 is not comprised completely of a dissolvable film. In particular, the lower housing is fashioned from plastic as is the upper body chamber 112 forming a tubular frame having formed therein a plurality of window openings 104. The openings 104 can be any shape which is convenient to dispensing the single premixed flavoring ingredient 122 and in FIG. 5 the openings are shown as being oblong or elliptical. Each of the openings 104 in the lower housing 118 is sealed with a dissolvable film such as methyl cellulose or gelatin as was described in the preferred embodiment. In practice, the dissolvable film can be heat sealed or cemented over just the individual window openings or, in the alternative, the film can be wrapped about the entire plastic tubular construction of the lower housing 118.

The bottom end of the lower housing 118 is terminated with a bottom plug 106 as by heat sealing at a plug interface 108. Since both the cap 126 and the bottom plug 106 are each heat sealed, neither element can be removed which prevents tampering with the premixed ingredients 122. As in the preferred embodiment, the preferred method of loading the ingredients into the single compartment 120 is top loading. After the bottom plug 106 is sealed into position and each of the window openings 104 are covered with the dissolvable film, the premixed ingredients are inserted from the top of the upper body chamber 112. Thereafter, the cap 126 is heat sealed into position and the apparatus 100 is sanitary over-wrapped prior to shipment.

In use, the flavoring and dispensing apparatus 100 is removed from the sanitary wrapper and the lower housing 118 is immersed into a fluid. The soluble film covering the window openings 104 dissolves providing a plurality of passages by which the premixed ingredients 122 are dispensed into the fluid. After the ingredients have escaped, the apparatus 100 can be held by the upper body chamber 112 and used as a stirring stick to mix the ingredients into the fluid. The window openings 104 formed in the lower housing 118 permit ready mixing. As before, the exterior surface of the upper body chamber 112 includes sufficient space for printing a written message 132 thereon such as product names, advertisements or messages of general interest.

The beverage flavoring and dispensing apparatus 200 of the second alternative embodiment includes an upper body chamber 212 having a plastic rectangular parallelepiped configuration. In this embodiment (as in the first alternative embodiment), the upper body chamber does not incorporate a spine member or the associated horizontally projecting vanes fused thereto but is a simple rectangle parallelepiped and formed, for example, from a solid injected molded process. However, the upper body chamber is joined to a lower housing 218 partially comprised of solid plastic at an interface junction 202. However, in this embodiment, the upper body chamber can be fused to the lower housing to form a single structural component. In effect, the upper body chamber 212 and the lower housing 218 form a single compartment 220 for storing a single premixed flavoring ingredient 222. The upper body chamber carries a cap 226 which is heat sealed to the upper body chamber at a cap interface 228. The cap 226 includes a plurality of air holes 230 for promoting the ready dispensing of the premixed ingredients 222.

The function and operation of the upper body chamber 212, the associated cap 226 and the air holes 230 of the apparatus 200 is very similar to that explained with respect to the apparatus 100 of the first alternative embodiment. However, the construction of the lower housing 218 is distinguishable as explained hereinbelow. The lower housing 218 is also a rectangular parallelepiped in which two of the four vertical faces are framed as rectangular vent openings 204 for dispensing the premixed ingredients. The remainder of the lower housing is fashioned from solid plastic. As in the first alternative embodiment, the vent windows 204 are covered with a dissolvable film such as methyl cellulose or gelatin. Each of the vent windows can be individually covered with the dissolvable film or the entire circumference of the lower housing can be wrapped with the film. In either case, the dissolvable film is retained in position by heat sealing or by cementing which are the methods employed for each of the embodiments disclosed in the present invention.

The bottom surface 206 of the lower housing 218 is also comprised of plastic and is integrally formed therewith as by, for example, an injection molding process. Top loading is the preferred method of inserting the premixed flavoring ingredients 222 into the single compartment 220 with the cap 226 removed and after the vent openings 204 have been sealed with the dissolvable film. Thereafter, the cap 226 is heat sealed to prevent tampering and the apparatus 200 is sanitary overwrapped for shipment.

In use, the lower housing 218 is immersed in a fluid and the soluble film covering the vent openings 204 dissolves providing parallel escape paths for the dispensed ingredients. The apparatus 200 can then be held by the upper body chamber 212 and used as a stirring stick with the opposing vent openings 204 assisting in ready mixing of the premixed ingredients 222 and the fluid. A written message 232 can be placed on the outer surface of the upper body chamber 212 as described in the previous embodiments.

From the foregoing, it will be appreciated that the beverage flavoring and dispensing apparatus 10 of the present invention provides multiple individual compartments 20 for increasing the number of flavoring ingredients carried in a single dispensing apparatus and increases the dispensing efficiency by simultaneously releasing each of the flavoring ingredients 22 into a fluid upon the dissolution of a soluble lower housing 18. Moreover, the apparatus 10 can be employed in the absence of any additional utensil, is simple to fabricate and the number of compartments necessary can be determined by the intended use.

Thus, the present invention has been described herein with reference to particular embodiments for particular applications. Those having ordinary skill in the art and access to the present teachings will recognize additional modifications, applications and embodiments within the scope thereof.

It is therefore intended by the appended claims to cover any and all such modifications, applications and embodiments within the scope of the present invention.

Accordingly,

What is claimed is:

1. A beverage flavoring and dispensing apparatus for use in providing a flavored beverage in a fluid comprising, in combination:

upper chamber means for handling said apparatus;

lower housing means for simultaneously dispensing a plurality of selected flavoring ingredients in said fluid, said dispensing means in mechanical communication with said handling means;

spine member means having a plurality of vanes horizontally extending from said spine member means and fused to said handling means for separating said plurality of flavoring ingredients, said vanes extending through said handling means and said dispensing means for forming a plurality of individual compartments, said compartments for storing said plurality of flavoring ingredients; and said lower housing dispensing means comprised of a soluble film enclosing said plurality of vanes for retaining said flavoring ingredients stored in said individual compartments, said soluble film dissolving when immersed in said fluid which simultaneously dispenses each of said plurality of flavoring ingredients for brewing said beverage.

2. The beverage flavoring and dispensing apparatus of claim 1 wherein said lower housing dispensing means is heat sealed to said upper chamber handling means.

3. The beverage flavoring and dispensing apparatus of claim 1 wherein said lower housing dispensing means is cemented to said upper chamber handling means.

4. The beverage flavoring and dispensing apparatus of claim 1 wherein said soluble film of said lower housing dispensing means is comprised of methyl cellulose.

5. The beverage flavoring and dispensing apparatus of claim 1 wherein said soluble film of said lower housing dispensing means is comprised of gelatin.

6. The beverage flavoring and dispensing apparatus of claim 1 wherein said spine member means is comprised of a central spine member located along a center vertical axis of said apparatus.

7. The beverage flavoring and dispensing apparatus of claim 1 wherein said upper chamber handling means further comprises a cap for sealing said plurality of individual compartments, said cap including a plurality of air vents at an interface between said cap and said upper chamber handling means for permitting ready dispensing of said flavoring ingredients.

8. The beverage flavoring and dispensing apparatus of claim 1 further including a message printed on an exterior surface of said upper chamber handling means.

9. The beverage flavoring and dispensing apparatus of claim 1 wherein said upper chamber handling means is comprised of plastic.

10. The beverage flavoring and dispensing apparatus of claim 1 wherein said upper chamber handling means is hollow for providing additional storage space for said flavoring ingredients.

11. The beverage flavoring and dispensing apparatus of claim 1 wherein said plurality of vanes horizontally extending from said spine member means and fused to said upper chamber handling means is utilized to mix said flavoring ingredients in said fluid after said lower housing dispensing means has dissolved.

12. The beverage flavoring and dispensing apparatus of claim 1 wherein each of said plurality of vanes includes at least one hole for improving the mixing efficiency of said vanes.

13. A beverage flavoring and dispensing apparatus for use in providing a flavored beverage in a fluid comprising, in combination:

an upper body chamber for handling said apparatus;

a lower housing in mechanical communication with said upper body chamber for simultaneously dispensing a plurality of selected flavoring ingredients in said fluid;

a spine member having a plurality of vanes horizontally extending from said spine member and fused to said upper body chamber, said vanes extending through said upper body chamber and said lower housing for forming a plurality of individual compartments, said compartments for storing said plurality of flavoring ingredients; and said lower housing comprised of a soluble film enclosing said plurality of vanes for retaining said flavoring ingredients stored in said individual compartments, said soluble film dissolving when immersed in said fluid which simultaneously dispenses each of said plurality of flavoring ingredients for brewing said beverage.

14. A beverage flavoring and dispensing apparatus for use in providing a flavored beverage in a fluid comprising, in combination:

an upper body chamber for handling said apparatus;

a lower housing in mechanical communication with said upper body chamber, said lower housing comprised of a plurality of vertical window openings for dispensing a charge of premixed flavoring ingredients; and said upper body chamber and said lower housing being joined to form a single compartment for storing said charge of premixed flavoring ingredients and each of said plurality of vertical window openings in said lower housing being sealed with a soluble film for retaining said premixed flavoring ingredients stored in said single compartment, said soluble film sealing said plurality of vertical window openings dissolving when immersed in said fluid for dispensing said charge of premixed flavoring ingredients and for brewing said beverage.

15. The beverage flavoring and dispensing apparatus of claim 14 wherein said upper body chamber and said lower housing are each tubular in shape.

16. The beverage flavoring and dispensing apparatus of claim 14 wherein said upper body chamber and said lower housing are each parallelepiped in shaped.

17. The beverage flavoring and dispensing apparatus of claim 14 wherein said upper body chamber further includes a cap for sealing said single compartment.

18. The beverage flavoring and dispensing apparatus of claim 17 wherein said cap includes a plurality of air vents at an interface between said cap and said upper body chamber for permitting ready dispensing of said premixed flavoring ingredients.

19. The beverage flavoring and dispensing apparatus of claim 14 wherein said plurality of openings in said lower housing are elliptical in shape.

20. The beverage flavoring and dispensing apparatus of claim 14 wherein said plurality of openings in said lower housing are rectangular in shape.

* * * * *